US008970631B2

(12) United States Patent
Nezu et al.

(10) Patent No.: US 8,970,631 B2
(45) Date of Patent: Mar. 3, 2015

(54) VIDEO DISPLAY DEVICE

(75) Inventors: Eifuu Nezu, Tokyo (JP); Tooru Kataoka, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 373 days.

(21) Appl. No.: 13/138,748

(22) PCT Filed: Mar. 30, 2009

(86) PCT No.: PCT/JP2009/056468

§ 371 (c)(1),
(2), (4) Date: Sep. 23, 2011

(87) PCT Pub. No.: WO2010/116445

PCT Pub. Date: Oct. 14, 2010

(65) Prior Publication Data

US 2012/0019720 A1 Jan. 26, 2012

(51) Int. Cl.
*G09G 5/30* (2006.01)
*G09G 5/391* (2006.01)

(52) U.S. Cl.
CPC ..... *G09G 5/391* (2013.01); *G09G 2340/0407* (2013.01)
USPC ..... 345/660

(58) Field of Classification Search
CPC ..... G06F 3/0481
USPC ..... 345/660
See application file for complete search history.

(56) References Cited

U.S. PATENT DOCUMENTS 5,920,351 A 7/1999 Takeshima et al.
7,812,888 B2 10/2010 Kataoka
8,345,036 B2 1/2013 Muramatsu
2002/0181934 A1 * 12/2002 Fukumori et al. ..... 386/66

(Continued)

FOREIGN PATENT DOCUMENTS

CN 1797375 A 7/2006
CN 1960436 A 5/2007

(Continued)

OTHER PUBLICATIONS

Chinese Office Action dated Jul. 22, 2013, with English translation.

(Continued)

*Primary Examiner* — Javid A Amini
(74) *Attorney, Agent, or Firm* — McGinn IP Law Group, PLLC

(57) ABSTRACT

A signal discriminating and monitoring circuit provides a full black detection circuit which detects a full black signal input during the change of the video signal and holds the detection result of the full black signal only during the specified time period. When a full black video signal is detected in the full black detection circuit, the signal discriminating and monitoring circuit detects whether the resolution of the video signal input has changed by determining whether the frequency of the horizontal synchronization signal included in the video signal of the next frame to be input changed above a preset value. When a change in the resolution of the video signal is detected, the change detected signal indicates that the detection result is output. When a scalar circuit receives the change detected signal, the video display signal is output as a constant value in order to set the display video in the static state.

12 Claims, 5 Drawing Sheets

(56) References Cited

U.S. PATENT DOCUMENTS

| | | | | |
|---|---|---|---|---|
| 2004/0239811 | A1* | 12/2004 | Ogawa | 348/581 |
| 2005/0062887 | A1* | 3/2005 | Choi et al. | 348/511 |
| 2006/0214927 | A1* | 9/2006 | Ikeda et al. | 345/204 |
| 2007/0070202 | A1* | 3/2007 | Kataoka | 348/194 |

FOREIGN PATENT DOCUMENTS

| | | | |
|---|---|---|---|
| CN | 101287083 | A | 10/2008 |
| JP | 09-135395 | A | 5/1997 |
| JP | 10-153989 | A | 6/1998 |
| JP | WO 98/39928 | | 9/1998 |
| JP | 2000-513902 | A | 10/2000 |
| JP | 2003-023578 | A | 1/2003 |
| JP | 2003-195803 | A | 7/2003 |
| JP | 2004-219726 | A | 8/2004 |
| JP | 2006-140627 | A | 6/2006 |
| JP | 2006-311327 | A | 11/2006 |
| JP | 2007-096875 | A | 4/2007 |
| JP | 2008-180830 | A | 8/2008 |
| WO | WO 2008/047568 | A1 | 4/2008 |

OTHER PUBLICATIONS

International Search Report dated Jun. 23, 2009 in PCT/JP2009/056468.

* cited by examiner

VIDEO DISPLAY DEVICE

TECHNICAL FIELD

The present invention relates to a video display device which is capable of receiving a plurality of types of video signals.

BACKGROUND ART

Video display devices (e.g., projectors) which receive a plurality of types of video signals (RGB signals, YCbCr signals, or video signals having different resolutions) determine the types and resolutions of video signals input thereto, and switch to an optimum image processing process depending on the determined types and resolutions to display images. The types and resolutions of video signals are determined by a process disclosed in Patent document 1, for example.

RGB signals include color signals of three primaries R (red), G (green), and B (blue), and a plurality of types of synchronizing signals. YCbCr signals include a Y (luminance) signal, a Cr (R−Y) color difference signal, a Cb (B−Y) color difference signal, and a plurality of types of synchronizing signals.

There are known a number of modes representative of the resolutions of video signals, e.g., VGA, SVGA, XGA, WXGA, SXGA, SXGA+, WSXGA, +UXGA, WUXGA, QXGA, etc.

FIG. 1 is a block diagram showing the arrangement of a video display device according to the background art. The video display device shown in FIG. 1 is of the arrangement disclosed in Patent document 1 described above.

As shown in FIG. 1, the video display device according to the background art includes A/D converter 1, signal discriminating and monitoring circuit 2, scaler circuit 3, CPU 4, panel drive circuit 5, and display panel 6.

A/D converter 1 converts video signals including synchronizing signals, input from a computer and various video reproducing devices, into digital signals.

Signal discriminating and monitoring circuit 2 separates a horizontal synchronizing signal and a vertical synchronizing signal from a video signal input thereto (hereinafter referred to as "input video signal"), detects various information required to determine the type and resolution of the input video signal from the horizontal synchronizing signal and the vertical synchronizing signal, and outputs the detected information to CPU 4. Some video display devices include a synchronizing separator, not shown, for separating a horizontal synchronizing signal and a vertical synchronizing signal from a video signal and supplying them to signal discriminating and monitoring circuit 2.

The information detected by signal discriminating and monitoring circuit 2 includes a horizontal synchronizing frequency, a vertical synchronizing frequency, a total number of lines, a synchronizing polarity (Nega or Posi), a synchronizing type (Sep(horizontal and vertical frequencies), CS (Composite Sync) or Sync on G (green signal synchronization), Tri Sync (Tri-level Synchronization), a scan type (Interlaced or Non-Interlaced), a vertical synchronizing width, a number of effective video lines, etc.

CPU 4 determines whether or not an input video signal has changed, and the type and resolution of an input video signal after it has changed, using the information detected by signal discriminating and monitoring circuit 2, and makes various required settings according to an image processing sequence which corresponds to the input video signal, based on the determined results. Parameters that are set by CPU 4 include, for example, the frequency-dividing ratio and phase of a PLL circuit (not shown) for generating a clock signal for use in A/D converter 1, resolution converting data for use in scaler circuit 3, the aspect ratio of a displayed image, a color system, etc.

Scaler circuit 3 converts the resolution of the input video signal into the resolution of display panel 6 according to the parameters set by CPU 4, generates a video display signal for displaying video images on display panel 6, and outputs the video display signal to panel drive circuit 5.

Signal discriminating and monitoring circuit 2 and scaler circuit 3 can be implemented by an LSI comprising a memory and various logic circuits, a CPU or the like for executing processing sequences according to programs, or the like.

Panel drive circuit 5 forms a video image on display panel 6 according to a video display signal output from scaler circuit 3. The video image formed on display panel 6 is projected onto a screen or the like by a projection optical system, not shown, including a light source, for example.

If the video display device is a direct-view-type display device, then display panel 6 comprises an LCD (Liquid Crystal Display), for example. If the video display device is a projection-type display device, then display panel 6 comprises DMD (Digital Mirror Device), for example.

As shown in FIG. 1, scaler circuit 3 includes frame memory 31, video input section 32, resolution converter 33, video output section 34, synchronization switch 35, and synchronizing signal generating circuit 36.

Frame memory 31 temporarily stores the data of successively input video signals (hereinafter referred to as "video data") frame by frame. Frame memory 31 has a memory capacity large enough to store 3 or more frames of video data. Video data are stored frame by frame in frame memory 31 by video input section 32. After the resolution of the video data is converted by resolution converter 33, the video data are output as a video display signal to panel drive circuit 5 by video output section 34.

At this time, synchronization switch 35 supplies video output section 34 with either a vertical synchronizing signal separated from the input video signal or a panel vertical synchronizing signal (60 Hz) which is asynchronous with the input video signal, according to an instruction from CPU 4. Video output section 34 outputs the vertical synchronizing signal supplied from synchronization switch 35, together with the video display signal, to panel drive circuit 5.

If a vertical synchronizing frequency that can be displayed on display panel 6 is of 60 Hz or lower, then when the vertical synchronizing signal separated from the input video signal has a frequency higher than 60 Hz, video images may not be displayed on display panel 6 in synchronism with the vertical synchronizing signal. With the video display device according to the background art, when the vertical synchronizing signal obtained from the input video signal has a frequency of 60 Hz or lower, video images are displayed on display panel 6 using the vertical synchronizing signal, and when the vertical synchronizing signal obtained from the input video signal has a frequency higher than 60 Hz, video images are displayed on display panel 6 using the panel vertical synchronizing signal (60 Hz) which is asynchronous with the input video signal.

The video display device shown in FIG. 1 successively performs a signal discriminating process for determining the type and resolution of the input video signal, makes image processing settings for an image processing sequence which corresponds to the determined input video signal, and performs a signal monitoring process for monitoring the video signal for changes, for thereby determining the type and resolution of the input video signal without errors and performing an appropriate image processing sequence corresponding to the video signal to display video images.

The signal discriminating process, the image processing settings, and the signal monitoring process performed by the video display device according to the background art shown in FIG. 1 will specifically be described below.

Operation of the video display device according to the background art with respect to an example wherein a computer is used as a video reproducing device, a video signal (RGB signals) output from an external video output terminal of the computer is input to the video display device, and the resolution of the video signal switches from WSXGA+ to WUXGA. Signal specifications of WSXGA+ are shown in Table 1, and signal specifications of WUXGA are shown in Table 2.

TABLE 1

| WSXGA + (1680 × 1050) | | | | |
|---|---|---|---|---|
| Hor Pixels | 1680 | Pixels | | |
| Ver Pixels | 1050 | Lines | | |
| Hor Frequency | 64.674 | KHz | 15.5 | mSec |
| Ver Frequency | 59.883 | Hz | 16.7 | nSec |
| Pixel Clock | 119 | MHz | 8.4 | μSec |
| Scan Type | Non Interlaced | | | |
| Hor Sync Polarity | Positive | | | |
| Ver Sync Polarity | Negative | | | |
| Hor AddrTime | 2080 | Pixels | 15.462 | μSec |
| Ver Total Time | 1920 | Pixels | 14.118 | μSec |
| Ver AddrTime | 1080 | Lines | 16.235 | mSec |
| Ver Sync Time | 6 | Lines | 0.093 | mSec |

TABLE 2

| WUXGA (1920 × 1200) | | | | |
|---|---|---|---|---|
| Hor Pixels | 1920 | Pixels | | |
| Ver Pixels | 1200 | Lines | | |
| Hor Frequency | 74.038 | KHz | 16.7 | mSec |
| Ver Frequency | 59.95 | Hz | 8.4 | nSec |
| Pixel Clock | 154 | MHz | 15.5 | μSec |
| Scan Type | Non Interlaced | | | |
| Hor Sync Polarity | Positive | | | |
| Ver Sync Polarity | Negative | | | |
| Hor AddrTime | 2080 | Pixels | 13.506 | μSec |
| Ver Total Time | 1920 | Pixels | 12.468 | μSec |
| Ver AddrTime | 1080 | Lines | 16.699 | mSec |
| Ver Sync Time | 6 | Lines | 0.093 | mSec |

When a video signal of WSXGA+ is input to the video display device, signal discriminating and monitoring circuit 2 performs a signal discriminating process by counting intervals of the horizontal synchronizing signal and the vertical synchronizing signal using a given reference clock signal to measure a horizontal synchronizing frequency (64.674 KHz: error±1% accuracy) and a vertical synchronizing frequency (59.883 Hz: error±0.5% accuracy).

Signal discriminating and monitoring circuit 2 also calculates the total number of lines (1080 Lines: error±1% accuracy) of the video signal from the counts produced by measuring the horizontal synchronizing frequency and the vertical synchronizing frequency, and determines the number of effective video lines of the input video signal based on the calculated total number of lines (1050 Lines).

Furthermore, signal discriminating and monitoring circuit 2 detects a synchronizing polarity (H: Posi, V: Nega), a synchronizing type (Sep), a scan type (Non-Interlaced), and a vertical synchronizing width (6 Lines), and outputs the detected information to CPU 4.

CPU 4 determines the type (RGB signals) and resolution (WSXGA+) of the input video signal from the information detected by signal discriminating and monitoring circuit 2, and determines an aspect ratio 16:10 of displayed images.

At this time, in order to avoid an erroneous determination as to whether or not the input video signal has changed, CPU 4 acquires a plurality of (e.g., five) information (e.g., the horizontal synchronizing frequency) from signal discriminating and monitoring circuit 2 in each processing cycle (e.g., 25 msec.) of CPU 4, and detects a change in the input video signal based on the acquired information. When CPU 4 detects a change in the input video signal, CPU 4 acquires a plurality of (e.g., three) information items from signal discriminating and monitoring circuit 2, and determines the type and resolution of the input video signal that has changed.

When CPU 4 determines the type and resolution of the input video signal, it proceeds to a process of making image processing settings, and supplies parameter values (frequency-dividing ratio and phase for A/D converter 1, resolution converting data for use in scaler circuit 3, an aspect ratio, a color system, etc.) which correspond to the determined type (RGB signals) and resolution (WSXGA+) of the input video signal, to A/D converter 1 and scaler circuit 3.

Thereafter, the video display device proceeds to the signal monitoring process for the input video signal.

According to the signal monitoring process, with the measuring accuracy being set to a range narrower than the measuring accuracy in the signal discriminating process, signal discriminating and monitoring circuit 2 calculates the total number of lines (1080 Lines: error±0.5% accuracy) of the input video signal from the counts produced by measuring the horizontal synchronizing frequency (64.7 KHz: error±0.5% accuracy) and the vertical synchronizing frequency (60 Hz: error±0.25% accuracy) of the input video signal, as with the above signal discriminating process.

CPU 4 acquires, in its processing cycle, the synchronizing polarity (H: Posi, V: Nega), the synchronizing type (Sep), the scan type (Non-Interlaced), and the vertical synchronizing width detected by signal discriminating and monitoring circuit 2, and monitors the type and resolution of the input video signal for a change.

If the input video signal has changed from WSXGA+ to WUXGA, then signal discriminating and monitoring circuit 2 detects the signal change, mutes the displayed image, and proceeds to the signal discriminating process. At this time, if the input video signal has changed, the video display device according to the background art may display a blue image or a logo.

In the signal discriminating process, signal discriminating and monitoring circuit 2 counts intervals of the horizontal synchronizing signal and the vertical synchronizing signal using a given reference clock signal to measure a horizontal synchronizing frequency (74.038 KHz: error±1% accuracy) and a vertical synchronizing frequency (59.95 Hz: error±0.5% accuracy), as with the above process.

Signal discriminating and monitoring circuit 2 also calculates the total number of lines (1235 Lines: error±1% accuracy) of the video signal from the counts of the horizontal synchronizing frequency and the vertical synchronizing frequency, and determines the number of effective video lines of the input video signal based on the calculated total number of lines (1200 Lines).

Furthermore, signal discriminating and monitoring circuit 2 detects a synchronizing polarity (H: Posi, V: Nega), a synchronizing type (Sep), a scan type (Non-Interlaced), and a vertical synchronizing width (6 Lines) of the video signal from the horizontal synchronizing signal and the vertical synchronizing signal, and outputs the detected information to CPU 4.

CPU 4 determines the type (RGB signals) and resolution (WUXGA) of the input video signal from the information detected by signal discriminating and monitoring circuit 2, and determines an aspect ratio 16:10.

At this time, in order to avoid an erroneous determination as to whether or not the input video signal has changed, CPU 4 acquires a plurality of (e.g., five) information (e.g., the horizontal synchronizing frequency) from signal discriminating and monitoring circuit 2 in each processing cycle (e.g., 25 msec.) of CPU 4, and detects a change in the input video signal based on the acquired information. When CPU 4 detects a change in the input video signal, CPU 4 acquires a plurality of (e.g., three) information items from signal discriminating and monitoring circuit 2, and determines the type and resolution of the input video signal that has changed.

When CPU 4 determines the type and resolution of the input video signal, it proceeds to a process of making image processing settings, and supplies parameter values (frequency-dividing ratio and phase for A/D converter 1, resolution converting data for use in scaler circuit 3, an aspect ratio, a color system, etc.) which correspond to the determined type (RGB signals) and resolution (WUXGA) of the input video signal, to A/D converter 1 and scaler circuit 3.

Thereafter, the video display device proceeds to the signal monitoring process for the input video signal to repeat the same process as described above.

Since the plural results detected by signal discriminating and monitoring circuit 2 are used to avoid an erroneous determination, as described above, the time required to determine whether or not the input video signal has changed depends on the stability of the input video signal. Therefore, the video display device according to the background art takes about 1 second to 2 seconds until it determines whether or not the input video signal has changed. As it takes time to determine whether or not the input video signal has changed, the video display device according to the background art takes about 2 seconds to 4 seconds after the input video signal has changed until an image processing sequence, depending on the type and resolution of the input video signal that has changed, is determined. During this time, disturbed video images may be displayed.

RELATED ART LITERATURES

Patent Literature 1: Japanese Patent Laid-Open No 2007-96875

SUMMARY

It is an object of the present invention to provide a video display device which is capable of determining in a shorter time whether or not the type and resolution of an input video signal has changed and which is free of disturbed displayed images when the type and resolution of the input video signal changes.

To achieve the above object, there is provided in accordance with an exemplary aspect of the present invention a video display device for generating a video display signal to display a video image based on an input video signal and for displaying the video image according to said video display signal, comprising:

a signal discriminating and monitoring circuit which includes a full black detection circuit for detecting a full black signal which is input when said video signal has changed and maintaining a detected result of said full black signal for a predetermined time, wherein if said full black detection circuit detects a full black mode of said video signal, said signal discriminating and monitoring circuit detects whether or not the resolution of the input video signal has changed by determining whether or not the frequency of a horizontal synchronizing signal included in a video signal of a next input frame has changed by a preset value or more, and, if said signal discriminating and monitoring circuit detects that the resolution of the input video signal has changed, said signal discriminating and monitoring circuit outputs a change detection signal representative of the changed resolution of the input video signal; and a scaler circuit which outputs said video signal at a fixed value for freezing the displayed video image when said scaler circuit receives said change detection signal.

BRIEF DESCRIPTION OF DRAWINGS

FIG. 1 is a block diagram showing the arrangement of a video display device according to the background art.

FIG. 2 is a schematic diagram showing an example of operation of a video reproducing device at the time of switching between video signals output to an external circuit.

FIG. 3 is a block diagram showing a configurational example of a video display device according to the present invention.

FIG. 4 is a block diagram showing a configurational example of a full black detection circuit shown in FIG. 3.

FIG. 5 is a schematic diagram showing an example of operation of the video display device shown in FIG. 3 at the time an input video signal has changed.

EXEMPLARY EMBODIMENT

The present invention will be described below with reference to the drawings.

Generally, when a computer and various video reproducing devices change the type and resolution of a video signal to be output to an external video display device, they temporarily set the video signal to a full black mode (0 V) and thereafter output the video signal whose type and resolution has changed.

Figure 2:
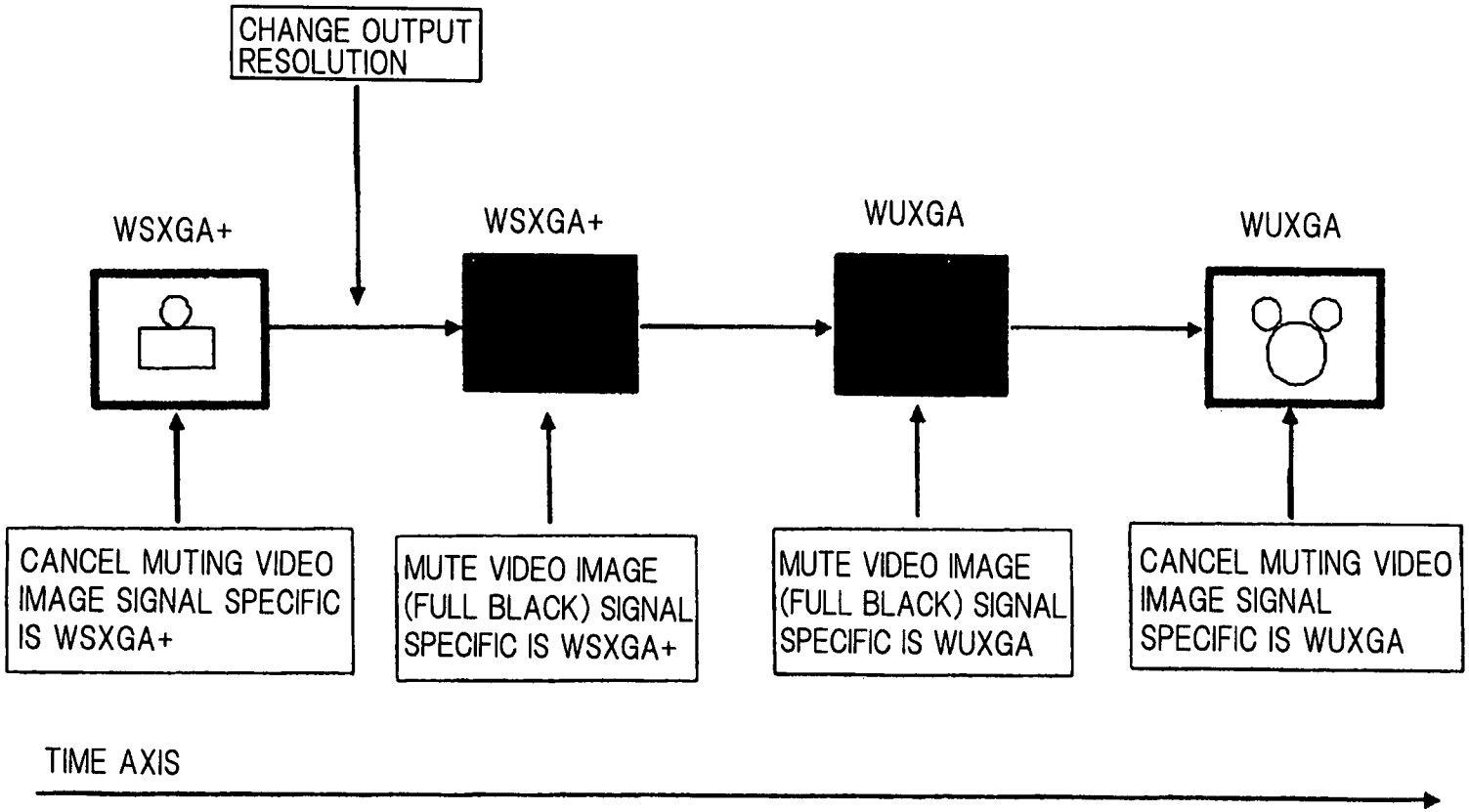
[FIG. 2 ]

FIG. 2 is a schematic diagram showing an example of operation of a video reproducing device at the time of switching between video signals output to an external circuit. Specifically, FIG. 2 shows an example of operation of the video reproducing device (computer) at the time the resolution of a video signal changes from WSXGA+ to WUXGA.

As shown in FIG. 2, when the resolution of a video signal changes from WSXGA+ to WUXGA, the computer mutes the displayed video image (sets the video signal to a full black mode) while maintaining the signal specifications of WSXGA+.

Then, the computer changes the signal specifications to WUXGA while keeping the displayed video image muted (keeping the video signal in the full black mode).

Finally, the computer cancels the muting of the displayed video image (the full black mode).

When the resolution of the input video signal has changed, the video reproducing device (computer) shown in FIG. 2 outputs only a video signal which is fully black (0 V). However, when the input video signal has changed, some video reproducing devices mutes the displayed video image (sets the video signal to a full black mode) and thereafter outputs a video signal for displaying a cursor or a character video image (e.g., an hourglass) indicating that the computer is in a processing sequence.

A video display device according to the present invention proposes a process of determining whether or not the type and resolution of an input video signal has changed by detecting a full black mode (0 V) of the input video signal, and of preventing the displayed video image from being disturbed when the type and resolution of an input video signal has changed.

Figure 3:
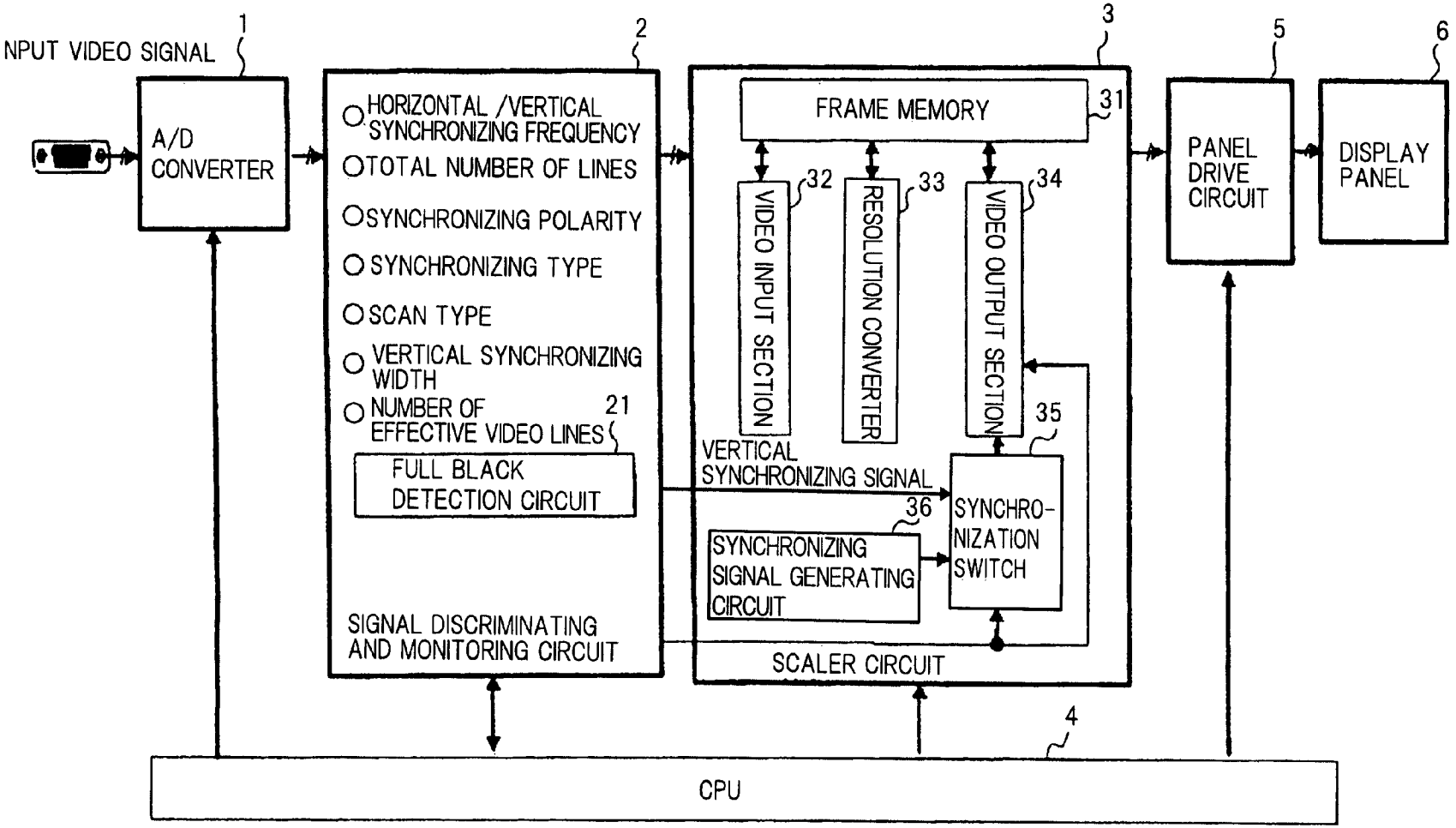
[FIG. 3 ]

FIG. 3 is a block diagram showing a configurational example of a video display device according to the present invention.

Figure 1:
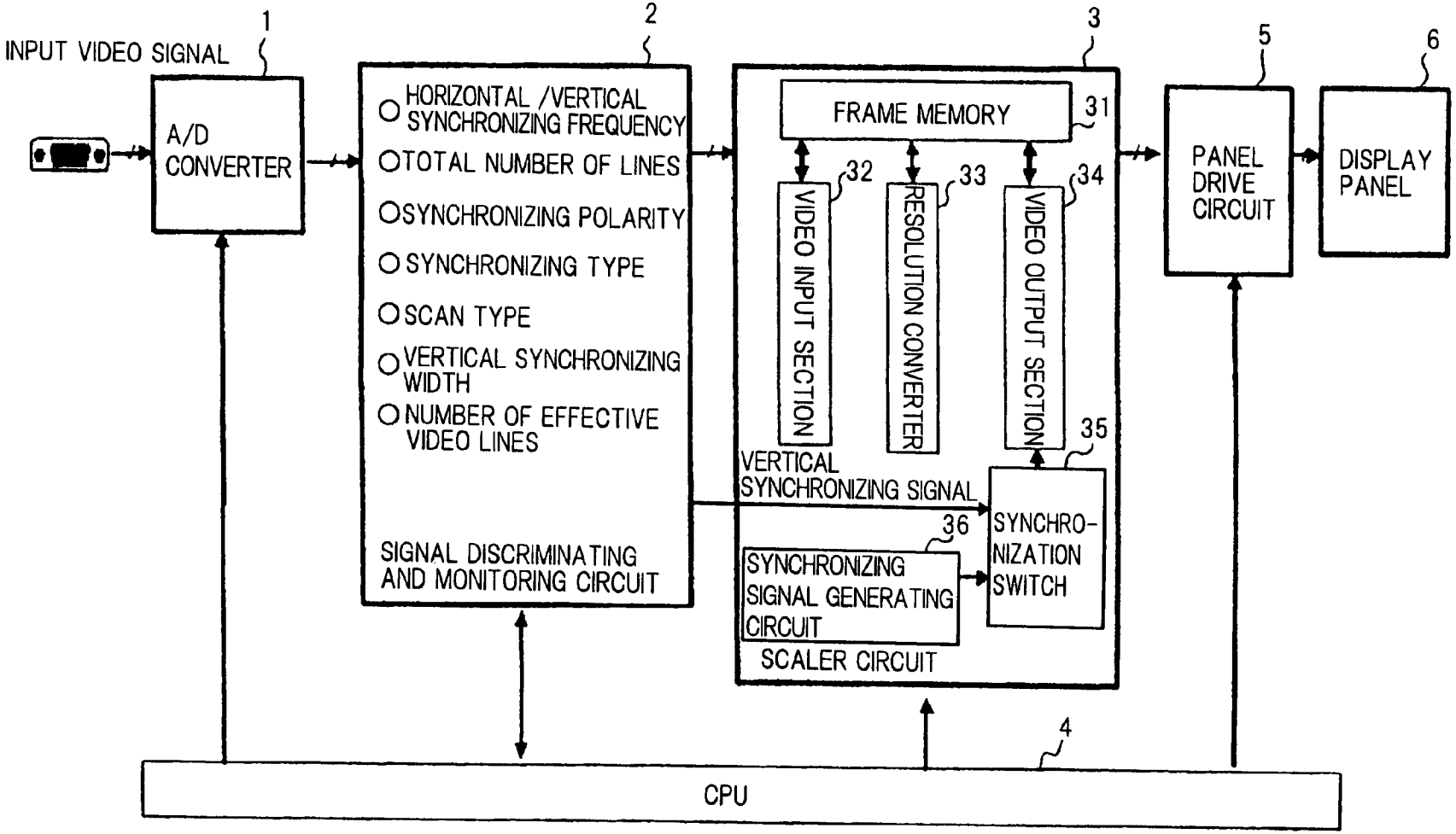
[FIG. 1 ]

As shown in FIG. 3, the video display device according to the present invention includes full black detection circuit 21 for detecting whether or not the input video signal is in the full black mode (0 V), in addition to signal discriminating and monitoring circuit 2 of the video display device according to the background art shown in FIG. 1. Other details of the video display device are identical to those of the video display device according to the background art shown in FIG. 1, and will not be described below.

Figure 4:
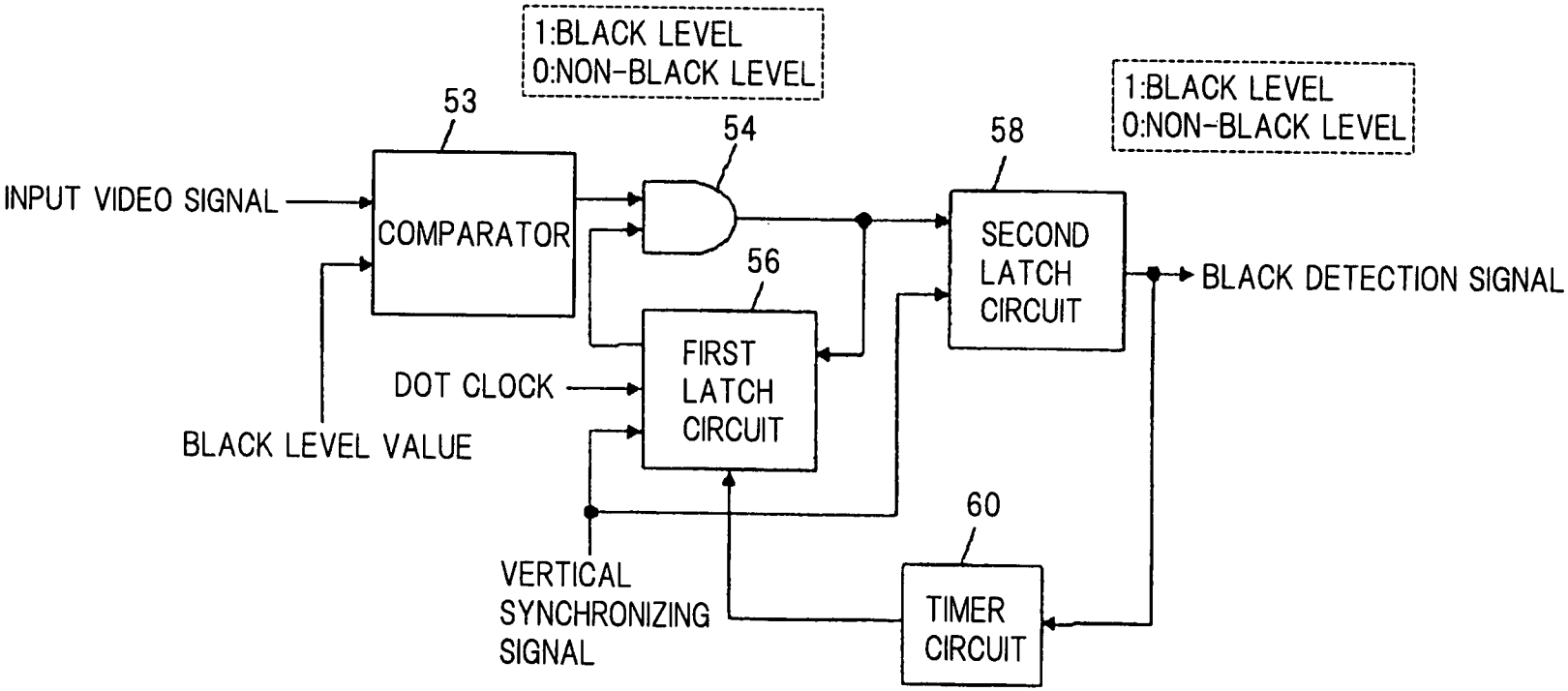
[FIG. 4 ]

FIG. 4 is a block diagram showing a configurational example of the full black detection circuit shown in FIG. 3.

As shown in FIG. 4, full black detection circuit 21 includes comparator 53, AND circuit 54, first latch circuit 56, second latch circuit 58, and timer circuit 60.

Comparator 53 compares the signal level of each color of the input video signal (RGB signals) with a preset black level value, and outputs the compared result. If the signal level of each color of the input video signal is smaller than the black level value, then comparator 53 outputs a value "1" (black level) as the compared result. If the signal level of even one color of the input video signal is greater than the black level value, then comparator 53 outputs a value "0" (non-black level) as the compared result.

AND circuit 54 outputs the logical product (1 bit) of the output value from comparator 53 and the output value from first latch circuit 56 to first latch circuit 56 and second latch circuit 58.

First latch circuit 56 latches (stores) the logical product output from AND circuit 54 in synchronism with a positive-going edge or negative-going edge of a dot clock signal which is generated by a PLL circuit (not shown) from the horizontal synchronizing signal and the vertical synchronizing signal in synchronism with the horizontal synchronizing signal and the vertical synchronizing signal, and supplies the latched value to an input terminal of AND circuit 54 through a feedback loop. The value latched (stored) by first latch circuit 56 is reset to an initial value ("1" in this case) in timed relation to the vertical synchronizing signal.

Second latch circuit 58 latches (stores) the output value from AND circuit 54 in timed relation to the vertical synchronizing signal, and outputs the latched value as a black detection signal. The black detection signal output from second latch circuit 58 is updated in timed relation to the vertical synchronizing signal.

In full black detection circuit 21, according to the present exemplary embodiment, the black detection signal output from second latch circuit 58 is input to timer circuit 60, and an output signal from timer circuit 60 is input as an enable signal to first latch circuit 56.

When timer circuit 60 receives the black detection signal from second latch circuit 58, timer circuit 60 controls first latch circuit 59 to stop its latching operation for a preset time (e.g., 2 seconds).

Specifically, during a period when two vertical synchronizing signal pulses are output, the full black detection circuit shown in FIG. 4 outputs a value "1" (black level) if the signal level of each color of the input video signal is smaller than the black level value, and outputs a value "0" (non-black level) if the signal level of each color of the input video signal is greater than the black level value even instantaneously. When second latch circuit 58 outputs "1" (black level) as a black detection signal, the full black detection circuit shown in FIG. 4 stops detecting the full black mode until a given time (e.g., about 2 seconds) set by timer circuit 60 elapses. At this time, the output values from AND circuit 54, first latch circuit 56, and second latch circuit 58 maintain fixed values until the given time set by timer circuit 60 elapses and a next vertical synchronizing signal pulse is input.

As described above, after the full black mode is detected, the detected full black mode is maintained for the given time set by timer circuit 60 to set the input video signal to the full black mode when the input video signal has changed. Even if a video signal representative of a cursor or a sand glass is input subsequently, the full black detection circuit does not output a value "0" (non-black level) in timed relation to a next vertical synchronizing signal pulse. The time set by timer circuit 60 may be a preset fixed time or may be changed by the user of the video display device.

Figure 5:
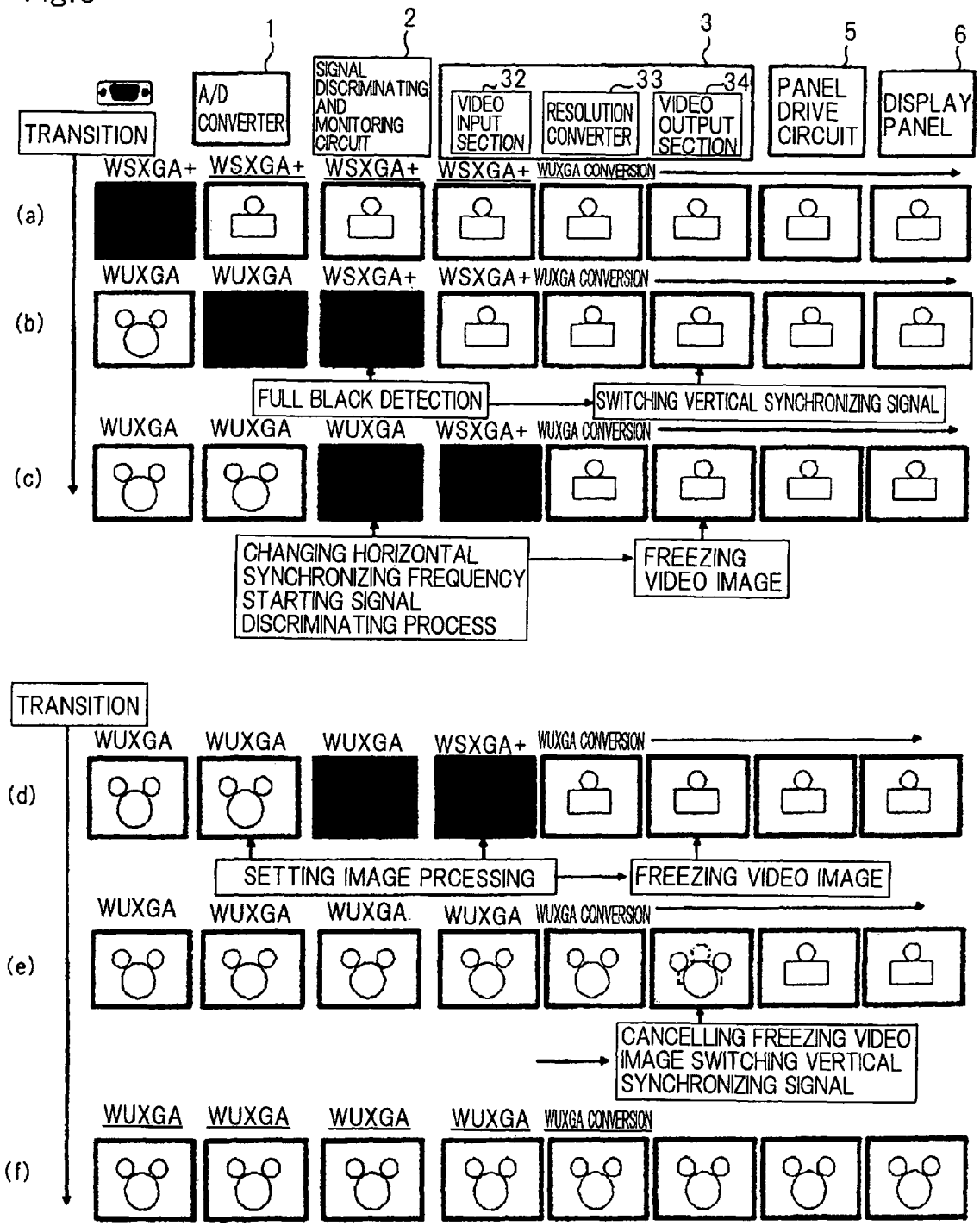
[FIG. 5 ]

FIG. 5 is a schematic diagram showing an example of operation of the video display device shown in FIG. 3 at the time the input video signal has changed.

FIG. 5 shows the manner in which input images corresponding to the components, arranged along a horizontal axis, of the video display device change with time (vertical axis). FIG. 5 also shows the manner in which the resolution of the input video signal switches from WSXGA+ to WUXGA. It is assumed that the resolution of the display panel of the video display device is compatible with WUXGA.

As shown in FIG. 5, when a video signal which is fully black (0 V) is input to the video display device according to the present exemplary embodiment in order to change the resolution of the display panel of the video signal from WSXGA+ to WUXGA (FIG. 5(*a*)), full black detection circuit 21 of signal discriminating and monitoring circuit 2 detects the full black mode (0 V) of the input video signal.

When full black detection circuit 21 of signal discriminating and monitoring circuit 2 detects that the input video signal is in the full black mode (0 V), the video display device according to the present exemplary embodiment proceeds to the signal discriminating process in which signal discriminating and monitoring circuit 2 outputs a black detection signal indicating the detected full black mode (0 V) to scaler circuit 3 directly rather than through CPU 4. When scaler circuit 3 receives the black detection signal from signal discriminating and monitoring circuit 2, scaler circuit 3 supplies the panel vertical synchronizing signal (60 Hz) which is asynchronous with the input video signal, generated by synchronizing signal generating circuit 36, via synchronization switch 35 to video output section 34. Video output section 35 supplies the panel vertical synchronizing signal (60 Hz), together with the video display signal, to panel drive circuit 5 (FIG. 5(*b*)).

When in the signal discriminating process, signal discriminating and monitoring circuit 2 counts intervals of the horizontal synchronizing signal and the vertical synchronizing signal which are included in the switched video signal, using a given reference clock signal to measure a horizontal synchronizing frequency (74.038 KHz: error±1% accuracy) and a vertical synchronizing frequency (59.95 Hz: error±0.5% accuracy).

When full black detection circuit 21 detects the full black mode (0 V) of the input video signal, signal discriminating and monitoring circuit 2 determines whether or not the frequency of the horizontal synchronizing signal included in a video signal in a next frame that is input (after 16.67 msec.) has changed by a preset value (e.g., ±0.5%) or more, thereby detecting whether or not the resolution of the input video signal has changed. If the frequency of the horizontal synchronizing signal has changed by the preset value or more, then signal discriminating and monitoring circuit 2 outputs a change detection signal to scaler circuit 3 directly rather than through CPU 4 (FIG. 5(*c*)). When scaler circuit 3 receives the change detection signal from signal discriminating and monitoring circuit 2, scaler circuit 3 sets the video display signal output from video output section 3 to a fixed value, freezing the video image displayed on display panel 6.

Signal discriminating and monitoring circuit 2 calculates the total number of lines (1235 Lines: error±1% accuracy) of the video signal from the counts of the horizontal synchronizing frequency and the vertical synchronizing frequency, and determines the number of effective video lines of the input video signal based on the calculated total number of lines (1200 Lines).

Furthermore, signal discriminating and monitoring circuit 2 detects a synchronizing polarity (H: Posi, V: Nega), a synchronizing type (Sep), a scan type (Non-Interlaced), and a vertical synchronizing width (6 Lines) of the video signal from the horizontal synchronizing signal and the vertical synchronizing signal, and outputs the detected information to CPU 4.

CPU 4 determines the type (RGB signals) and resolution (WUXGA) of the input video signal from the information detected by signal discriminating and monitoring circuit 2, and determines an aspect ratio 16:10.

When CPU 4 determines the type and resolution of the input video signal, it proceeds to a process of making image processing settings, and supplies parameter values (frequency-dividing ratio and phase for A/D converter 1, resolution converting data for use in scaler circuit 3, an aspect ratio, a color system, etc.) which correspond to the determined type and resolution of the input video signal, to A/D converter 1 and scaler circuit 3. At this time, signal discriminating and monitoring circuit 2 controls the video output section 34 of scaler circuit 3 to keep the displayed image frozen (FIG. 5(*d*)).

When the process of making image processing settings made by CPU 4 is completed, signal discriminating and monitoring circuit 2 outputs a setting completion signal indicating that the process of making image processing settings is completed to scaler circuit 3.

When scaler circuit 3 receives the setting completion signal from signal discriminating and monitoring circuit 2, scaler circuit 3 cancels the freezing of the displayed video image caused by video output section 34, supplies the vertical synchronizing signal separated from the input video signal by synchronization switch 35 to video output section 34, and outputs the vertical synchronizing signal and the video display signal generated from the changed video signal from video output section 34 to panel drive circuit 5 (FIG. 5(*e*)).

In the example of operation shown in FIG. 5, since the resolution of the input video signal has changed from WSXGA+ to WUXGA, the vertical synchronizing frequency is of 60 Hz or lower. Thereafter, after image processing settings have been made, the video signal of WSXGA+ and the video signal of WUXGA display video images on display panel 6 in synchronism with the vertical synchronizing signal of the input video signal. Consequently, it may appear that there is no need to use the panel vertical synchronizing signal (60 Hz) in the signal discriminating process and the process of making image settings.

However, as shown in Table 1 and Table 2, the vertical synchronizing frequency of WSXGA+ is of 59.8 Hz and the vertical synchronizing frequency of WUXGA is of 59.95 Hz, and hence they are slightly different from each other. If the vertical synchronizing signal separated from the input video signal is used in the signal discriminating process and the process of making image settings, then the displayed image may possibly slightly move in vertical directions the instant that the freezing of the displayed image is canceled.

At the time the full black mode of the input video signal is detected, the video display device according to the present exemplary embodiment switches to a video display mode using the asynchronous panel vertical synchronizing signal (60 Hz) at the time it detects the full black mode of the input video signal, and switches to a video display mode using the vertical synchronizing signal separated from the changed input video signal after the signal discriminating process and the process of making image processing settings (FIG. 5(*f*)).

Finally, the image display device proceeds to the signal monitoring process. In the signal monitoring process, signal discriminating and monitoring circuit 2 monitors the type and resolution of the input video signal for a change according to the same sequence as with the signal discriminating process, in each cycle of the vertical synchronizing frequency (16.67 msec. if the vertical synchronizing frequency is of 60 Hz) separated from the input video signal, rather than in the processing cycle (e.g., 25 msec.) of CPU 4.

The image display device according to the present invention judges that the input video signal has changed at the time it detects the full black mode of the input video signal, and detects a change in the resolution of the input video signal based on whether or not the horizontal synchronizing signal, for example, included in the video signal of a next input frame has changed. Therefore, unlike the background art, it is not necessary to determine whether or not the input video signal has changed using a plurality of detected results from signal discriminating and monitoring circuit 2. Consequently, the time required to determine whether or not the input video signal has changed is reduced.

When the image display device according to the present invention detects a change in the resolution of the input video signal based on a change in the horizontal synchronizing signal, the image display device freezes the displayed video image. After the process of making image processing settings corresponding to the changed input video signal has been completed, the image display device cancels the freezing of the displayed video image. Therefore, the video image can be displayed depending on the changed type and resolution of the input video signal, seamlessly without being disturbed.

Since full black detection circuit 21 includes timer circuit 60 and, after the full black mode is detected, the full black mode is maintained using timer circuit 60 and the video image can be kept frozen until the video signal output from the video reproducing device is stabilized even if a video signal representing a cursor or a sand glass is input immediately after the full black mode at the time the input video signal has changed. Accordingly, even if a video signal representing a cursor or a sand glass is input immediately after the full black mode, the video image can be displayed depending on the changed type and resolution of the input video signal, seamlessly without being disturbed.

Although the present invention has been described above with reference to the exemplary embodiment, the present invention should not be limited to the above exemplary embodiment. Various changes that can be understood by those skilled in the art can be made to the arrangement and details of the present invention within the scope of the invention.

The invention claimed is:

1. A video display device for generating a video display signal to display a video image based on an input video signal and displaying the video image according to said video display signal, said video display device comprising:

a signal discriminating and monitoring circuit which includes a full black detection circuit for detecting a full black signal which is input when said video signal has changed and maintaining a detected result of said full black signal for a predetermined time, wherein if said full black detection circuit detects a full black mode of said video signal, said signal discriminating and monitoring circuit detects whether a resolution of the input video signal has changed by determining whether a frequency of a horizontal synchronizing signal included in a video signal of a next input frame has changed by a preset value or more, and, if said signal discriminating and monitoring circuit detects that the resolution of the input video signal has changed, said signal discriminating and monitoring circuit outputs a change detection signal representative of the changed resolution of the input video signal; and a scaler circuit which outputs said video signal at a fixed value for freezing the displayed video image when said scaler circuit receives said change detection signal, wherein said full black signal detected by said full black detection circuit comprises a signal for muting the displayed video image which is fully black.

2. The video display device according to claim 1, wherein said signal discriminating and monitoring circuit outputs a setting completion signal representative of completion of a process of making image processing settings corresponding to the changed video image when said process of making image processing settings is completed; and said scaler circuit cancels the freezing of said displayed video image when said scaler circuit receives said setting completion signal.

3. The video display device according to claim 1, wherein said signal discriminating and monitoring circuit outputs a black detection signal when said full black detection circuit detects the full black mode of said video signal; and said scaler circuit includes a synchronizing signal generating circuit for generating a panel vertical synchronizing signal which is asynchronous with said video signal, and said scaler circuit outputs the generated video display signal together with said panel vertical synchronizing signal when said scaler circuit receives said black detection signal.

4. The video display device according to claim 3, wherein said signal discriminating and monitoring circuit outputs a setting completion signal representative of completion of a process of making image processing settings corresponding to the changed video image when said process of making image processing settings is completed; and said scaler circuit outputs the generated video display signal together with a vertical synchronizing signal separated from the changed video image when said scaler circuit receives said setting completion signal.

5. The video display device according to claim 1, wherein said signal discriminating and monitoring circuit detects whether the resolution of the input video signal has changed at a same time as said detecting said full black signal.

6. The video display device according to claim 1, wherein said full black signal and whether the resolution of the input video has changed are detected concurrently.

7. The video display device according to claim 1, wherein said full black detection circuit comprises a timer circuit which sets said predetermined time.

8. The video display device according to claim 7, wherein once said full black mode is detected, said full black mode is maintained using said timer circuit.

9. The video display device according to claim 7, wherein said full black detection circuit further comprises:

a first latch circuit connected to said timer circuit; and a second latch circuit connected to said timer circuit, wherein said second latch circuit outputs a black detection signal when said full black detection circuit detects the full black mode of said video signal.

10. The video display device according to claim 9, wherein said black detection signal output from said second latch circuit is input to said timer circuit, and wherein an output signal from said timer circuit is input as an enable signal to said first latch circuit.

11. The video display deice according to claim 10, wherein when said timer circuit receives said black detection signal from said second latch circuit, said timer circuit controls said first latch circuit to stop a latching operation of said first latch circuit for said preset time.

12. The video display device according to claim 1, wherein said signal discriminating and monitoring circuit detects one or more of a synchronizing polarity, a synchronizing type, a scan type, and a vertical synchronizing width of said video signal from said horizontal synchronizing signal.

* * * * *